US007314289B2

(12) United States Patent
Montagne

(10) Patent No.: US 7,314,289 B2
(45) Date of Patent: Jan. 1, 2008

(54) LUMINAIRE PROVIDING AN OUTPUT BEAM WITH A CONTROLLABLE PHOTOMETRIC DISTRIBUTION

(75) Inventor: Louis Montagne, Cailloux sur Fontaines (FR)

(73) Assignee: Koninklijke Philips Electronics, N.V., Eindhoven (NL)

( * ) Notice: Subject to any disclaimer, the term of this patent is extended or adjusted under 35 U.S.C. 154(b) by 178 days.

(21) Appl. No.: 10/536,260

(22) PCT Filed: Nov. 11, 2003

(86) PCT No.: PCT/IB03/05098

§ 371 (c)(1),
(2), (4) Date: May 24, 2005

(87) PCT Pub. No.: WO2004/049765

PCT Pub. Date: Jun. 10, 2004

(65) Prior Publication Data

US 2006/0146528 A1 Jul. 6, 2006

(30) Foreign Application Priority Data

Nov. 27, 2002 (FR) ..... 02 14901

(51) Int. Cl.
*F21V 9/00* (2006.01)

(52) U.S. Cl. ..... 362/231; 362/235; 362/295

(58) Field of Classification Search ..... 362/231, 362/235, 295

See application file for complete search history.

(56) References Cited

U.S. PATENT DOCUMENTS

| | | | | |
|---|---|---|---|---|
| 5,749,646 | A | 5/1998 | Brittell | |
| 6,220,722 | B1 * | 4/2001 | Begemann | 362/231 |
| 6,299,337 | B1 | 10/2001 | Bachl et al. | |
| 6,357,889 | B1 | 3/2002 | Duggal et al. | |
| 6,367,949 | B1 * | 4/2002 | Pederson | 362/240 |
| 6,461,008 | B1 * | 10/2002 | Pederson | 362/35 |
| 2002/0006040 | A1 | 1/2002 | Kamada et al. | |
| 2004/0004835 | A1 * | 1/2004 | Tsai | 362/231 |

FOREIGN PATENT DOCUMENTS

| | | | |
|---|---|---|---|
| DE | 19901669 | A1 | 8/2000 |
| EP | 1113215 | A2 | 7/2001 |
| WO | 9930537 | A1 | 6/1999 |

* cited by examiner

*Primary Examiner*—Stephen F Husar
*Assistant Examiner*—Meghan K. Dunwiddie

(57) ABSTRACT

The invention relates to a luminaire comprising a plurality of light sources fixedly located in a plurality of positions and comprising at least an electroluminescent diode. Said sources are focused by the same optical system fixed relative to the plurality of sources. Said luminaire comprises electronic means for dimming sources in their emission intensity independently of one another and as a function of their respective positions relative to said optical system. The invention provides an output beam having a dimmable photometric distribution in time and in space at the output of said optical system.

3 Claims, 5 Drawing Sheets

LUMINAIRE PROVIDING AN OUTPUT BEAM WITH A CONTROLLABLE PHOTOMETRIC DISTRIBUTION

Figure 1:
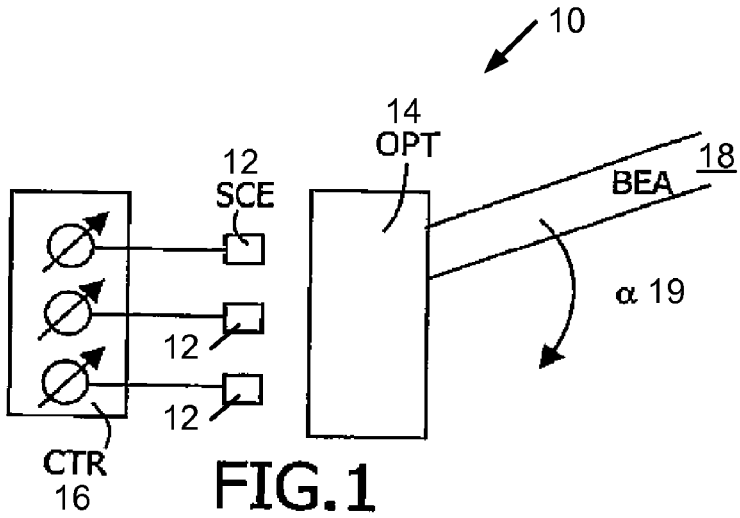

The invention relates to a luminaire comprising a plurality of sources fixedly arranged in a plurality of positions and comprising at least one electroluminescent diode. The invention also relates to luminaires working in illumination and luminance.

Such a luminaire is known from patent application WO 99/30537. In this document, the light emitted by the plurality of sources comprising at least one electroluminescent diode is focused into an output beam by an optical system. Said optical system is movable and thus renders it possible to modify the photometric distribution of the output beam. Means for modifying the color of the emitted light are also presented, which means are formed by a separate control of diodes of different colors.

The invention is based on the following considerations.

In the prior art, the modification of the output beam as regards its photometric distribution is generated by a physical movement of mechanical parts. The use of such a movement implies the use of mechanical and energetic means for activating said optical system. The modification of the photometric distribution is possible in a single direction adjacent the axis of the luminaire in the cited document, unless the luminaire is displaced in its entirety. This considerably limits the application possibilities of such a luminaire. Moreover, the duration of the mechanical movements does not provide a practically instantaneous orientation of the beam. This again reduces the field of application of the luminaire. The color of the beam centered on the luminaire axis is controlled in that groups of diodes, i.e. light sources, of three different colors are independently controlled.

It is an object of the invention to obtain a beam of controllable photometric distribution with a high degree of flexibility and a high speed without the use of mechanical means for displacing parts, while still the advantages offered by the use of electroluminescent diodes are retained.

For this purpose, a luminaire as described in the opening paragraph, according to the invention, is characterized in that said sources are focused by one and the same optical system which is in a fixed position with respect to said plurality of sources, while said luminaire comprises electronic means designed for controlling the sources and capable of controlling the intensities of said sources independently of one another and as a function of their respective positions relative to said optical system so as to obtain an output beam with a photometric distribution which is controllable in time and in space at the output of said optical system. The positions of the sources are such that the control means are capable of modifying the photometric distribution of the beam exclusively by controlling the individual diodes independently.

In an advantageous embodiment, said sources are provided with means for changing their colors, and the means for activating the sources comprise means for controlling the colors of said sources.

In a first embodiment of the invention, said optical system comprises at least one surface shaped as part of a sphere.

In a second embodiment of the invention, said optical system comprises at least one surface shaped as part of a cylinder.

In an advantageous application of the invention, the photometric distribution of the output beam has at least two maxima of different colors.

Figure 2:
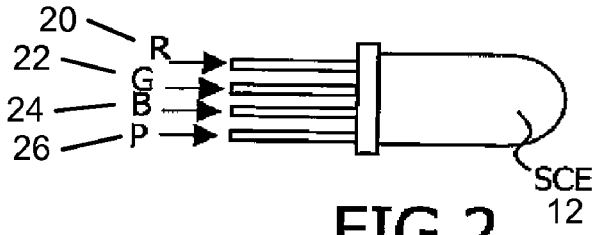
Figure 3A:
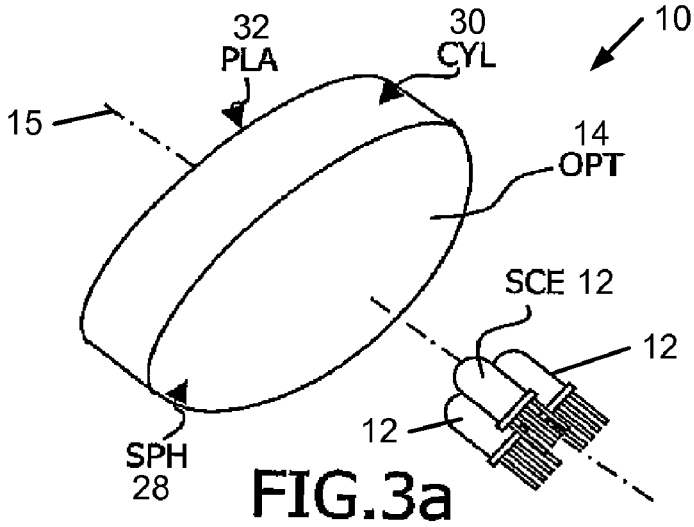
Figure 3B:
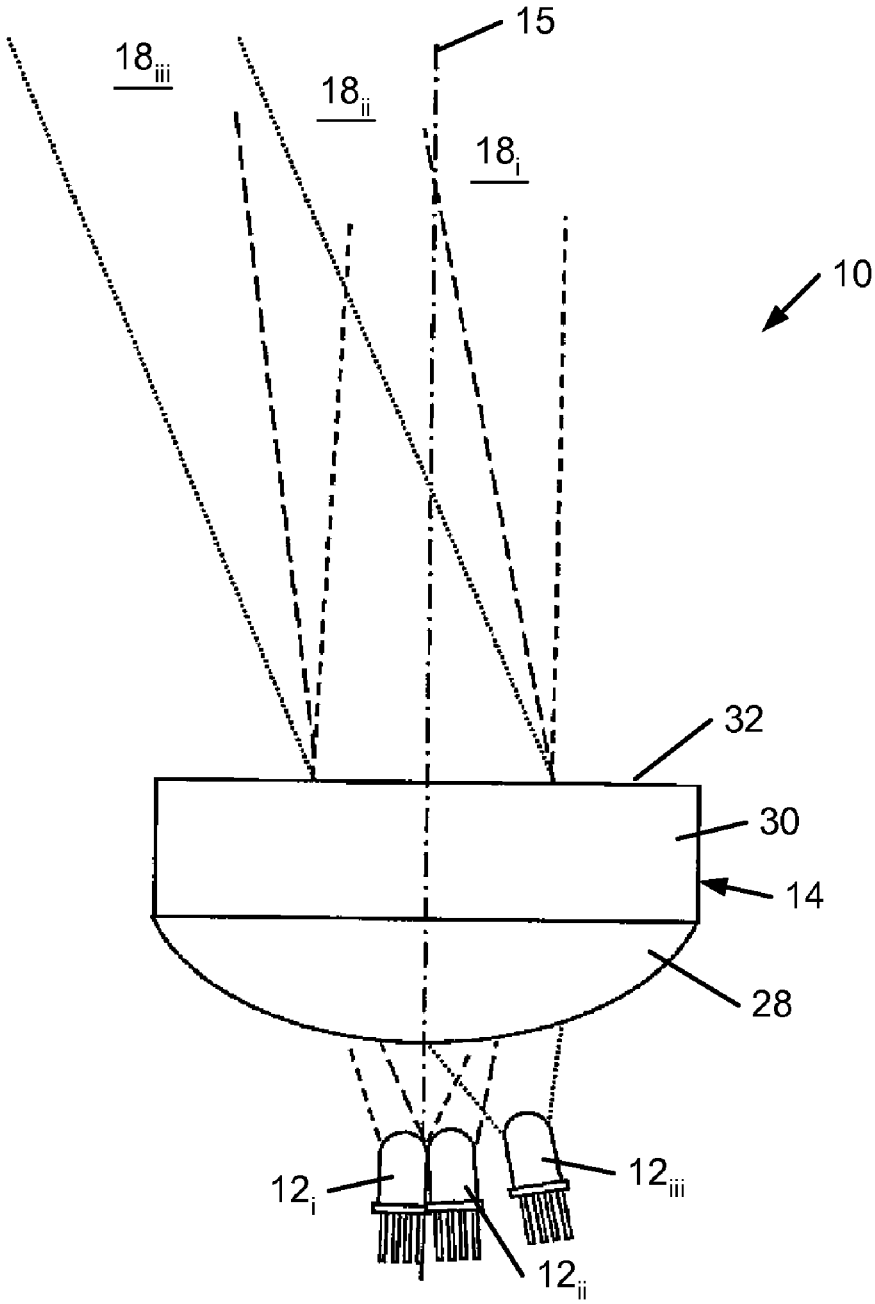
Figure 3C:
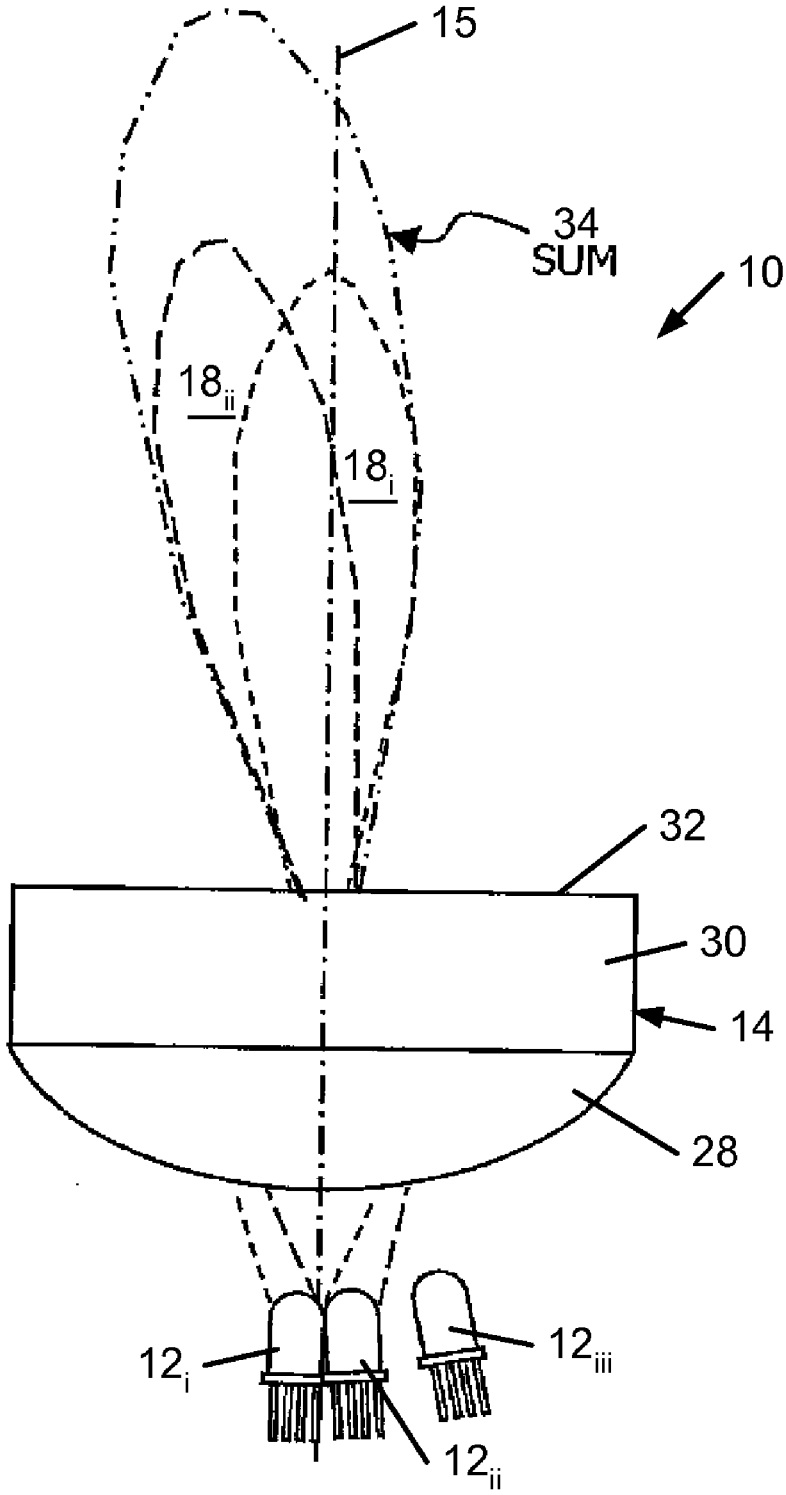
Figure 4A:
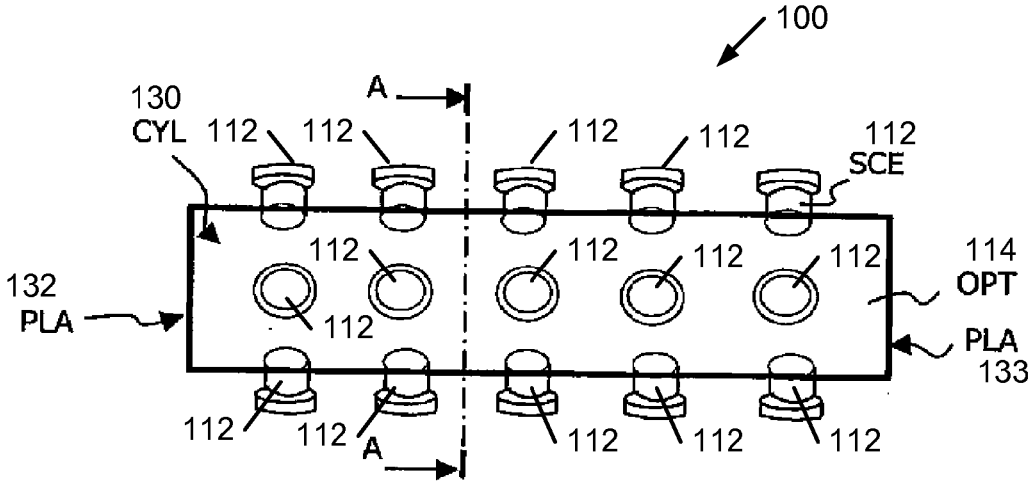
Figure 4B:
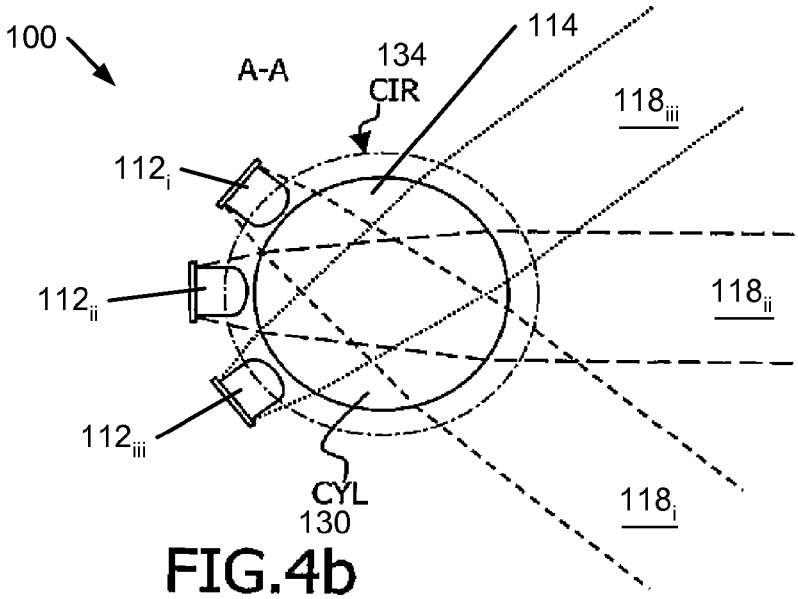
Figure 5:
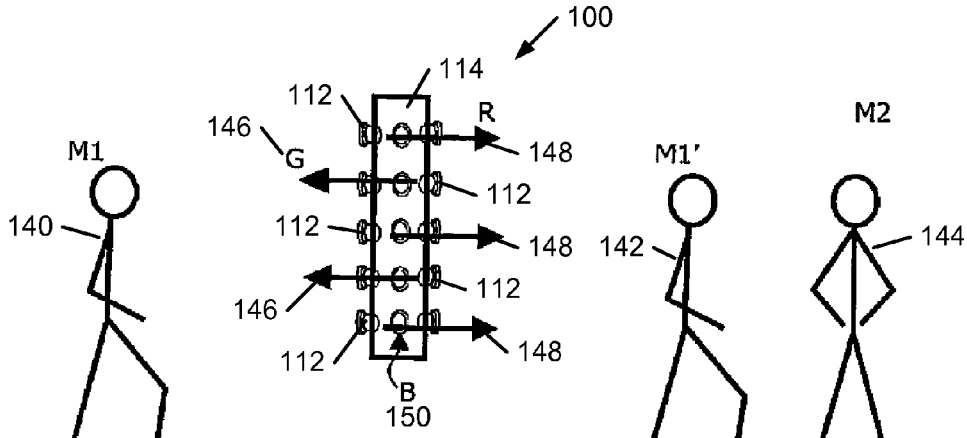
Figure 6:
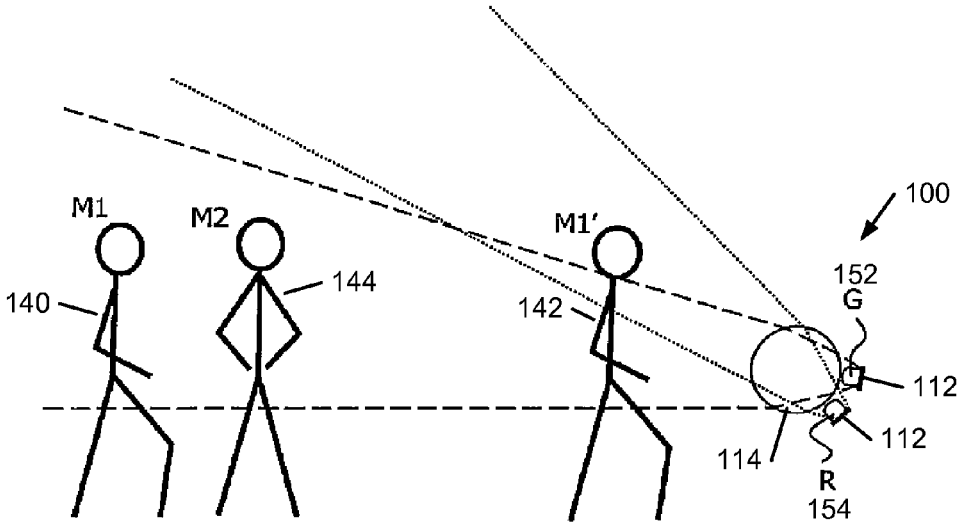

The invention will be better understood in the light of the following description of a few embodiments, which is given by way of example and with reference to the annexed drawings, in which:

FIG. 1 is a diagram of a luminaire according to the invention,

FIG. 2 shows a diode as can be advantageously implemented in a luminaire according to the invention, FIG. 3*a* is a diagrammatic perspective view of a luminaire in a first embodiment of the invention, FIGS. 3*b* and 3*c* illustrate the creation of output beams with variable photometric distribution in the first embodiment of the invention, FIG. 4*a* is a diagrammatic front elevation of a luminaire in a second embodiment of the invention, FIG. 4*b* illustrates the photometric distribution of the output beam in a cross-section of a luminaire according to the second embodiment of the invention, FIG. 5 illustrates a first practical application of a luminaire according to the second embodiment of the invention, and FIG. 6 illustrates a second practical application of a luminaire according to the second embodiment of the invention.

The following description is given so as to enable those skilled in the art to realize and utilize the invention. This description is given in the context of the patent application and the requirements thereof. Various alternatives to the preferred embodiment will be evident to those skilled in the art, and the general principles of the invention detailed herein may be applied to alternative embodiments.

The following remarks relate to the reference symbols. Similar components are indicated with identical letters in all Figures. Several similar components may be present in one and the same Figure. In that case a number or a suffix will be added to the reference letter so as to distinguish between the similar components. The number or the suffix may be omitted for reasons of convenience. This relates to the description as well as to the claims.

FIG. 1 is a diagram of a luminaire 10 according to the invention. Such a luminaire 10 comprises a plurality of sources SCE 12 fixedly located in a plurality of positions and comprising at least one electroluminescent diode. According to the invention, said sources 12 are focused by one and the same optical system OPT 14 which is in a fixed position with respect to the plurality of sources SCE 12. Said luminaire 10 comprises electronic control means CTR 16 for the sources 16 capable of controlling the intensity of emission of said sources 12 independently of one another as a function of their respective positions relative to said optical system OPT 14 so as to obtain an output beam BEA 18 with a photometric distribution which is controllable in time and in space at the output of said optical system OPT 14. The control of the luminous intensity for each of the diodes 12 renders it possible to control the intensity and the direction ($\alpha$) 19 of the output beam 18.

FIG. 2 shows a source SCE 12 according to an advantageous embodiment. This source SCE 12 comprises means for changing the color. This advantageous embodiment is not restrictive: diodes of a single color or several groups of diodes of different colors may be implemented in a luminaire according to the invention. This source SCE 12 thus is, for example, an electroluminescent diode comprising three chips inside one housing. Each of said chips emits in a given primary color: red, green, and blue. In the present example, connection elements R 20, G 22, and B 24 are each connected to a cathode within one of the chips, said cathode being brought to a certain potential so as to cause the corresponding chip to emit in one of the colors red, green, blue. The connection element P 26 is connected to an anode which is common to all chips. Each of these chips is independently controlled so as to cause the light emitted by the diode 12 to assume any possible color through combination of the colors. The electronic control means CTR 16 then comprise means for controlling the colors of the sources 12. These electronic means 16 control a luminous intensity for each of the chips R, G, B. Each source 12 is thus capable of assuming any of the possible colors, including white. The quasi-immediateness of the electronic control of the diodes renders it possible to obtain changes in color and in color temperature which are almost instantaneous. The electronic control 16 is formed, for example, by a device denoted Xitanium 25 W Dimmable LED Power Driver from the Philips company. This electronic control device 16 is capable of controlling the intensities of three independent channels of electroluminescent diodes 12 in accordance with a desired scenario. The control of the diode luminaire 10 may utilize a set of such devices 16 having the number of desired channels. The same type of electronic control device 16 is also used in the case of a luminaire comprising diodes of a single color or groups of diodes of different colors (providing the possibility of modifying the color of an output beam as well) in that said device 16 is programmed so as to respond to the demand for an independent control of the diodes 12. Any equivalent device providing an independent control of a plurality of electroluminescent elements 12 may alternatively be used. The independence of the control actions on the diodes 12, according to the invention, renders it possible to orient the beam 18 by controlling its photometric distribution. This orientation is also quasi-instantaneous, a given orientation corresponding to the activation of at least one particular diode 12. Each of the sources 12 contributes to a portion of the beam 18 which portion of the beam 18 will be practically instantaneously controllable. The beam 18 is modified in a practically instantaneous manner without noise and without wear on components. The output beam 18 may thus be locally modified as a function of the luminous level produced by the diode 12 and as a function of the color assumed by each of the sources 12. The beam 18 may thus be intensive, extensive, asymmetrical, and accordingly controllable into various shapes. The invention thus offers possibilities for shaping the beam 18 practically instantaneously and with a very high flexibility. The independence of the control of the diodes 12 and the point-shaped character of such sources 12 thus render it possible to obtain a wide diversity of shapes in accordance with the invention without generating mechanical movements of components. This diversity is indeed dependant, according to the invention, on the number of diodes 12 capable of being activated. The higher the number of diodes 12 the greater the diversity. Given the fact that electroluminescent diodes 12 are powerful and compact light sources, the increase in their number will not lead to a major increase in space occupation. The output beam 18 can be accurately shaped thanks to the dimensions of the diodes. The invention may also be used for projecting gobbos. The gobbos are provided as part of the optical system 14 itself or are placed within the luminaire 10 in a fixed position with respect to the optical system 14, but always in the path of the beam 18 generated by at least one given diode 12. One or several distinct images may thus be projected as a function of the direction ($\alpha$) 19, each direction corresponding to at least one diode 12 that emits a luminous energy. Furthermore, the entirely electronic character of the control means 16 for the sources 12 renders it possible to realize very simple servo-controls as a function of external events, which events may in particular be measured by sensors.

The advantages of the invention over known projection systems is the absence of mechanical movements, the absence of shutters or diaphragms for masking certain portions of the beam 18, the absence of filter holders, and the absence of the need to rotate the luminaire 10, so the absence of inertia. The size of the luminaire 10 is also strongly reduced by the fact that no component need be displaced.

FIGS. 3*a, b, c* diagrammatically show a luminaire 10 in a first embodiment of the invention. According to this first embodiment, the optical system 14 is made from a transparent material having an axis 15. Said optical system 14 comprises a surface 28 in the shape of part of a sphere SPH, a cylindrical surface CYL 30, and a planar surface PLA 32 in a configuration as shown in FIG. 3. This optical system 14 may be one single body such as a lens, or it may be a hollow element filled with a transparent material having a refractive index higher than that of air. The optical system 14 enables the light emitted by the sources SCE 12 to be focused. This focusing is different in dependence on the position of the source 12 relative to the optical system 14.

Examples of beams 18 obtained from different sources 12 are shown in FIG. 3*b*. Only three diodes are shown here for reasons of clarity in the drawing, but the number of diodes used in a luminaire 10 according to the invention will generally be of the order of about ten up to a hundred. The individual beams 18 ($\mathbf{18}_i$, $\mathbf{18}_{ii}$, $\mathbf{18}_{iii}$) generated by each of the three diodes 12 ($\mathbf{12}_i$, $\mathbf{12}_{ii}$, $\mathbf{12}_{iii}$) shown are illustrated in different kinds of broken lines. It is apparent that, with a single diode emitting, the output beam thus obtained is advantageously intensive. The intensive character of the beam 18 is given by the nature of the optical system 14 and the position of the relevant source 12 with respect to a focal surface. The invention may thus be adapted so as to comply with a set of conditions in dependence on the envisaged application and the nature of the beams required thereby. The adaptation to a given application leads to a modification in the focusing properties of the optical system 14 and the positions of the diodes 12 with respect thereto, while retaining the principles of the invention. According to the invention, a single diode 12 may thus produce a focused beam in a given direction. The possible directions are limited by the structure of the optical system 14. An optical system 14 as shown in FIG. 3*a,b,c*, however, manufactured from a material with a suitable refractive index of around 1.5 renders possible an orientation over a major portion of space, generally a quarter of space. A suitable biconvex optical system 14 (for example a sphere) may provide an orientation of the beams 18 over practically a full half-space. An anti-reflection element may be advantageously used to augment the possible orientation range still further, with the further addition of diodes 12 at the periphery of the optical system 14. The beam 18 may vary in intensity and in color in dependence on the chosen controls for the emitting diode 12. If several diodes 12 are emitting, the resulting beam 18 ($\mathbf{18}_i$, $\mathbf{18}_{ii}$, $\mathbf{18}_{iii}$) is now extensive to the extent to which the beams overlap at least in a certain geographical zone. This extensive beam 18 may be controlled as regards its intensity and color through a control of the luminous intensity and color of each of the diodes 12 involved in the formation of the beam 18. The invention also renders it possible to obtain a photometric distribution having several maxima. In fact, the beams 18 ($\mathbf{18}_i$, $\mathbf{18}_{iii}$)generated by two distinct diodes 12 ($\mathbf{12}_i$, $\mathbf{12}_{iii}$) may be fully separate at a certain distance. This pre-supposes that the beam 18 obtained from one diode 12 is sufficiently directional. This is the case when, for example, the diode 12 is close to a focus point of the optical system 14 or in a position where the beam 18 converges in a given point. This latter convergence property may be particularly appreciated in the illumination of objects, for example, in a museum. In such applications, the miniaturization made possible by the use of the diodes is highly advantageous. The invention moreover renders it possible to have a single optical output for close-range illuminations. The beam 18 may also be dynamic, i.e. respond to interactive commands.

FIG. 3*c* in its turn shows the photometric distribution obtained through combination of the luminous intensities emitted by two diodes 12 ($\mathbf{12}_i$, $\mathbf{12}_{ii}$). It is apparent that the resulting beam SUM 34 thus obtained is more extensive than that obtained from a single diode.

This first embodiment may thus be used in any application in which a light beam is to assume variable directions within short time periods. Its use is then mostly aimed at lighting applications.

FIGS. 4*a* and 4*b* show a second embodiment 100. The optical system 114 here has two planar surfaces PLA (132, 133) and one cylindrical surface CYL 130. The same luminaire is diagrammatically shown in a cross-section A-A in FIG. 4*b*. The sources SCE 112 are located in a circle CIR 134 which is concentric with the cylinder CYL 130. The rays 118 ($\mathbf{118}_i$, $\mathbf{118}_{ii}$, $\mathbf{118}_{iii}$) emitted by each diode 112 ($\mathbf{112}_i$, $\mathbf{112}_{ii}$, $\mathbf{112}_{iii}$) are focused by the cylinder CYL 130. This focusing renders it possible to obtain a beam which is the more directional as the diodes 112 are placed closer to the focal surface (of the optical system 114). The positions of the focal points depend on the index of the material from which the cylinder 130 is manufactured. The choice of index of the material used thus depends again on the envisaged application.

Applications of this latter embodiment are shown in FIGS. 5 and 6. A cylinder as shown in FIG. 4*a* is vertically placed, for example, in a street. It is then used in accordance with FIG. 5 for orienting pedestrians (140,142,144) towards a location as a function of the color perceived by them. These applications then function in dependence on the luminance properties on which the invention is brought to bear. Thus M1 140 sees the light G 146 emitted by the diodes situated on the right in FIG. 5. This light 146 is emitted (luminance) and is, for example, green. In this case M1 140 will be aware that he is following the correct direction and will walk on until reaching position M1' 142. M2 (indicated by reference numeral 144), looking towards the luminaire 100, will see a light R 148 emitted by the diodes 112 situated on the left in FIG. 5. This light 148 is, for example, red. M2 144 will thus be aware that the direction in which he is looking is not the correct one. Another cylinder placed farther to the right beyond the Figure and oriented as the one shown in its turn will indicate to him a correct direction. The third group of diodes 112 viewed from the front emits, for example, a blue color B 150 which indicates a neutral direction. Gobbos may also be placed on the cylindrical surface in front of each diode 112 so as to assist the comprehension of the guidance, for example an arrow from left to right for the region of the blue beam. A change in the guidance, for example in case of an emergency evacuation, is practically instantaneous and easy to command.

Another application shown in FIG. 6 renders it possible to keep pedestrians away from a danger or protected zone. This application is interesting, for example, in museums and for keeping persons away from a given passage or a danger: station platform, etc.

In FIG. 6, M1 140 and M2 144 see the light emitted by the diode 112 referenced G 152, i.e. luminance, which emits a green color here. M2 144 then chooses to stay in this position authorized by the green color, while M1 140 continues until reaching a position M1' 142. In this position 142, he now sees the light emitted by the diode R 154, emitting a red color, from its luminance. This tells him that he must not proceed any further.

This red light 154 may be quickly changed by electronic means controlling the color of the diode 112, for example when a train has arrived and the passengers are invited to board. The electronic command proposed by the invention renders possible a simple and automatic control of the luminaire 100 according to the invention. Security applications may necessitate, besides the implementation of the invention proper, the presence of supplementary means and of improvements and/or developments relating inter alia to the compliance with security regulations.

The Figures shown merely indicate special embodiments of the invention. Thus the invention should not be regarded as being limited to the embodiments described, but rather to have a wider scope in accordance with the principles and the characteristics described above. For example, the optical system (14,114) may be formed by a complete sphere or alternatively by a cylindrical portion, or by any other form providing a focusing into beams of distinct photometric distribution for each of the sources (12,112).

The invention claimed is:

1. A luminaire comprising:

a plurality of sources fixedly arranged in a plurality of positions and comprising at least one electroluminescent diode, the at least one electroluminescent diode including three chips within one housing, each chip for emitting a primary color and being independently controllable so as to cause light emitted by the electroluminescent diode to assume any possible color through a combination of primary colors;

an optical system comprising a cylinder having a focal surface that is at a fixed position with respect to said plurality of sources, the plurality of sources being located on a circle that is concentric to the cylinder, and wherein the optical system is further adapted to enable light from said sources entering the optical system via the focal surface to be focused into an output beam, wherein focusing for each source of said plurality of sources is different in dependence on the fixed position of a respective source relative to the focal surface of the optical system; and electronic control means designed for controlling the plurality of sources and capable of controlling intensities of light from said plurality of sources (i) independently of one another and (ii) as a function of their respective positions relative to the focal surface of said optical system so as to (iii) accurately shape and orient the output beam with a photometric distribution which is controllable in time and in space at the output of said optical system.

2. A luminaire as claimed in claim 1, wherein said sources are each provided with means for changing their respective colors, and wherein the means for controlling the sources further comprises means for controlling the colors of said sources.

3. A luminaire as claimed in claim 1, wherein the photometric distribution of the output beam has at least two maxima of different colors.

* * * * *